US007143744B2

(12) United States Patent
Araki

(10) Patent No.: US 7,143,744 B2
(45) Date of Patent: Dec. 5, 2006

(54) DETECTION DEVICE AND METHOD FOR THROTTLE OPENING DEGREE, AND COMPENSATION DEVICE AND METHOD FOR TARGET THROTTLE OPENING DEGREE

(75) Inventor: Koji Araki, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 2 days.

(21) Appl. No.: 11/173,016

(22) Filed: Jul. 5, 2005

(65) Prior Publication Data

US 2006/0005810 A1 Jan. 12, 2006

(30) Foreign Application Priority Data

Jul. 7, 2004 (JP) ..... 2004-200696

(51) Int. Cl.
*F02D 9/10* (2006.01)

(52) U.S. Cl. ..... 123/399; 123/361

(58) Field of Classification Search ..... 123/361, 123/399

See application file for complete search history.

(56) References Cited

U.S. PATENT DOCUMENTS 4,401,074 A * 8/1983 Horiuchi et al. ..... 123/339.13
4,905,653 A * 3/1990 Manaka et al. ..... 123/674
5,146,886 A * 9/1992 Mannle et al. ..... 123/399
6,345,604 B1 * 2/2002 Ahrns et al. ..... 123/361

FOREIGN PATENT DOCUMENTS

| | | |
|---|---|---|
| JP | 63-038650 | 2/1988 |
| JP | 11-270395 | 10/1999 |
| JP | 2000-257490 | 9/2000 |
| JP | 2003-148177 | 5/2003 |

* cited by examiner

*Primary Examiner*—Erick Solis
(74) *Attorney, Agent, or Firm*—Kenyon & Kenyon LLP

(57) ABSTRACT

A throttle opening degree TA is converted to a reference opening area SB based on a map MAPsbta representing the relationship between the throttle opening degree and the opening area in a deposit-free state. An actual opening area SA after the deposit amount is changed is obtained by subtracting an opening area change amount dDS corresponding to a change in deposit amount from the reference opening area SB. Since the opening area change amount dDS is uninfluenced by changes of the engine operational zones, the actual opening area SA is accurately determined. By converting the actual opening area SA to a control throttle opening area TAa based on the map MAPsbta, the control throttle opening degree TAa that reflects the actual opening area with improved accuracy can be detected.

15 Claims, 5 Drawing Sheets

DETECTION DEVICE AND METHOD FOR THROTTLE OPENING DEGREE, AND COMPENSATION DEVICE AND METHOD FOR TARGET THROTTLE OPENING DEGREE

BACKGROUND OF THE INVENTION

The present invention relates to detection methods and devices for a throttle opening degree related to adjustment of the intake air amount of internal combustion engines, and to compensation methods and devices for a target throttle opening degree.

For internal combustion engines, particularly gasoline engines, a technique for accurately adjusting the throttle opening degree by conducting an electronic control procedure in correspondence with the operational state of an accelerator pedal and that of an engine is known.

The throttle opening degree is detected by a throttle opening degree sensor provided in a throttle valve. The throttle valve is actuated and controlled by an electric motor such that the throttle opening degree reaches a target value set in correspondence with an accelerator pedal position, an operational state or a required combustion state.

However, when a deposit of unburned fuel or lubricant oil is formed in the installation portion of the throttle valve, the relationship between the throttle opening degree and the intake air amount is changed. That is, even if the throttle opening degree is maintained as constant, the intake air amount may be decreased as compared to the initial state. This makes it difficult to accurately operate and control the internal combustion engine.

Conventionally, in order to solve this problem, when the engine is operated in a specific operational state, such as an idle state, the difference between the reference throttle opening degree and the actual throttle opening degree is determined and learned. The learned value is used as a correction value in a throttle opening degree control procedure when the engine is operated in different operational states other than the aforementioned state (see Japanese Laid-Open Patent Publication No. 2000-257490). Further, according to the aforementioned document, the difference between the reference throttle opening degree and the actual value varies among the different engine operational states even if the amount of the deposit is maintained as constant, such that the correction value for such difference has to be changed correspondingly. Therefore, in this technique, the learned value is corrected by a learned value correction coefficient that varies depending on in which operational state the engine is running. The throttle opening degree is thus adjusted by the corrected learned value.

However, if the opening degree of the throttle valve is much larger than that of the idle state, the learned value must be increased by a relatively large margin, in accordance with the correction coefficient. This may decrease the correction accuracy of the difference between the reference throttle opening degree and the actual value. That is, in an engine operational state different from the specific operational state in which learning is performed as aforementioned, it is difficult to control the throttle opening degree with enhanced accuracy.

SUMMARY OF THE INVENTION

Accordingly, it is an objective of the present invention to provide a detection method and a detection device for throttle opening degree and a compensation method and a compensation device for a target throttle opening degree that are capable of controlling the throttle opening degree with improved accuracy in any one of the engine operational states, regardless of change of the amount of deposits formed on a throttle valve installation portion.

The means and operational advantages of the present invention for achieving the objective thereof will hereafter be explained.

A first aspect of the present invention is a detection method for throttle opening degree. The method includes a step of converting throttle opening degree, which is determined through actual detection, to an opening area based on a relationship between a throttle opening degree and the opening area of a throttle valve installation portion when the throttle valve installation portion is in a reference deposit state. The method further includes a step of determining an actual opening area by subtracting an opening area change amount of the throttle valve installation portion, which corresponds to change of deposit amount with respect to the reference deposit state, from the opening area. The method also includes a step of determining a control throttle opening degree by converting the actual opening area to the control throttle opening degree based on the relationship between the throttle opening degree and the opening area of the throttle valve installation portion in the reference deposit state.

The relationship between the opening area determined from the actual throttle opening degree and the intake air amount has been studied by comparison between an unused, deposit-free throttle valve installation portion and a deposit-formed throttle valve installation portion (hereinafter, referred to as a "deposit-formed object"). As a result, it has been found that, even though the intake air amount changes in correspondence with changes in the throttle opening degree, the difference of the opening area between the unused object and the deposit-formed object is maintained as constant regardless of the change of the intake air amount (see, for example, FIG. 5, which will be explained later). In other words, it has been made clear that the opening area change amount corresponding to the change of the deposit amount is uninfluenced by changes of the engine operational zones.

Therefore, a constant value of the opening area change amount may be used for correcting the actual throttle opening degree, regardless of the engine operational zone.

Accordingly, the actual throttle opening degree is converted to the corresponding opening area, based on the relationship between the throttle opening degree and the opening area of the throttle valve installation portion held in the reference deposit state. The opening area change amount corresponding to the change of the deposit amount is then subtracted from the obtained opening area. In this manner, the actual opening area after the deposit amount is changed is determined.

The opening area change amount, which corresponds to the change of the deposit amount, is a value that has been detected in any one of the engine operational zones. However, regardless of whether or not the current engine operational zone in which the throttle opening degree is to be detected corresponds to the engine operational zone in which the opening area change amount has been detected, the opening area change amount is uninfluenced by changes of the engine operational zones, as has been described. It is thus possible to accurately determine the actual opening area of the current throttle valve operational state.

The obtained accurate actual opening area is converted to the control throttle opening degree in correspondence with the relationship between the throttle opening degree and the opening area of the throttle valve installation portion in the reference deposit state. In this manner, the throttle opening degree of the throttle valve in the reference deposit state, which is, for example, the throttle opening degree of the throttle valve installation portion in the unused state, is determined.

It is thus possible to detect the control throttle opening degree that reflects the actual opening area in the current engine operational zone with enhanced accuracy in any one of the engine operational zones after change of the deposit amount occurs. Thus, by using the control throttle opening degree, the throttle opening degree can be controlled with improved accuracy regardless of which operational zone the engine is operated in, after the amount of the deposit-formed in the throttle valve installation portion is changed.

A second aspect of the present invention is a compensation method for target throttle opening degree. The method includes a step of converting the target throttle opening degree to a target opening area based on the relationship between the throttle opening degree and the opening area of the throttle valve installation portion when the throttle valve installation portion is in a reference deposit state. The method also includes a step of determining a corrected target opening area by adding an opening area change amount of the throttle valve installation portion, which corresponds to change of deposit amount with respect to the reference deposit state, to the target opening area. The method further includes a step of determining an updated target throttle opening degree by converting the corrected target opening area to the updated target throttle opening degree based on the relationship between the throttle opening degree and the opening area of the throttle valve installation portion in the reference deposit state.

As has been described, the opening area change amount corresponding to change of the deposit amount is uninfluenced by changes of the engine operational zones. Thus, when compensating the target throttle opening degree set for adjusting the throttle opening degree in correspondence with the change of the deposit amount, the opening area is corrected in correspondence with the opening area change amount. The correction is thus completed simply by using the constant opening area change amount, in any one of the engine operational zones.

Accordingly, the target throttle opening degree is converted to the corresponding target opening area in correspondence with the relationship between the throttle opening degree and the opening area of the throttle valve installation portion in the reference deposit state. The opening area change amount corresponding to the change of the deposit amount is then added to the obtained target opening area. In this manner, the corrected target opening area, which is the target opening area after the deposit amount is changed, is determined.

The opening area change amount, which corresponds to the change of the deposit amount, is a value that has been detected in any one of the engine operational zones. However, regardless of whether or not the current engine operational zone in which the target throttle opening degree is to be detected corresponds to the engine operational zone in which the opening area change amount has been detected, the opening area change amount is uninfluenced by changes of the engine operational zones. It is thus possible to accurately determine the current corrected target opening area.

The obtained accurate corrected target opening area is converted to the updated target throttle opening degree in correspondence with the relationship between the throttle opening degree and the opening area of the throttle valve installation portion in the reference deposit state. This makes it possible to determine a target throttle opening degree suitable for the throttle valve installation portion in a state after the deposit amount has changed. In this manner, the initial target throttle opening degree is compensated for in correspondence with change of the deposit amount.

Thus, it is possible to accurately set the target throttle opening degree for the current engine operational zone regardless of which operational zone in which the engine is operated, after the deposit amount is changed. Thus, by using the target throttle opening degree, the throttle opening degree can be controlled with improved accuracy in any one of the engine operational zones, after the amount of the deposit-formed in the throttle valve installation portion changes.

A third aspect of the present invention is a detection device for throttle opening degree in an internal combustion engine. The device includes throttle opening degree detecting means for detecting actual throttle opening degree of a throttle valve, change amount detecting means for detecting an opening area change amount corresponding to change in deposit amount of a throttle valve installation portion, and converting means for converting the throttle opening degree as actually detected by the throttle opening degree detecting means to an opening area based on a relationship between the throttle opening degree and the opening area of the throttle valve installation portion in a reference deposit state. The device also includes computing means for determining an actual opening area by subtracting the opening area change amount detected by the change amount detecting means from the opening area determined by the converting means. The device further includes throttle opening degree converting means for determining a control throttle opening degree by converting the actual opening area determined by the computing means to the control throttle opening degree based on the relationship between the throttle opening degree and the opening area of the throttle valve installation portion in the reference deposit state.

As has been described, the opening area change amount corresponding to a change of the deposit amount is uninfluenced by changes of the engine operational zones. Thus, when correcting the actual throttle opening degree in correspondence with the change of the deposit amount, the opening area is corrected in correspondence with the opening area change amount. The correction is thus conducted simply by using the constant opening area change amount, in any one of the engine operational zones.

Therefore, the converting means converts the actual throttle opening degree to the opening area based on the relationship between the throttle opening degree and the opening area of the throttle valve installation portion in the reference deposit state. The computing means computes an actual opening area by subtracting the opening area change amount detected by the change amount detecting means from the opening area determined by the converting means. The throttle opening degree converting means determines a control throttle opening degree by converting the actual opening area to the control throttle opening degree based on the relationship between the throttle opening degree and the opening area of the throttle valve installation portion in the reference deposit state. In this manner, the throttle opening degree of the reference deposit state, which is, for example, the throttle opening degree of the throttle valve installation portion in the unused state, is determined.

Accordingly, it is possible to determine a control throttle opening degree that reflects the actual opening area in the current engine operational zone with enhanced accuracy in any one of the engine operational zones, after the deposit amount has changed. Thus, by using the control throttle opening degree, the throttle opening degree can be controlled with improved accuracy regardless of which operational zone the engine is operated in, after the amount of the deposits formed in the throttle valve installation portion has been changed.

A fourth aspect of the present invention is a compensation device for target throttle opening degree for adjusting throttle opening degree of an internal combustion engine. The device includes change amount detecting means for detecting an opening area change amount corresponding to a change in deposit amount in a throttle valve installation portion. The device also includes converting means for converting the target throttle opening degree to a target opening area, based on the relationship between the throttle opening degree and an opening area of the throttle valve installation portion in a reference deposit state. The device further includes correcting means for determining a corrected target opening area by adding the opening area change amount detected by the change amount detecting means to the target opening area obtained by the converting means. The device also includes setting means for determining an updated target throttle opening degree from the corrected target opening area determined by the correcting means based on the relationship between the throttle opening degree and the opening area of the throttle valve installation portion in the reference deposit state.

As has been described, the opening area change amount corresponding to a change of deposit amount is uninfluenced by changes of the engine operational zones. Thus, when compensating the target throttle opening degree in correspondence with the change of deposit amount, the opening area is corrected in correspondence with the opening area change amount. The compensation is thus conducted simply by using the constant opening area change amount, in any one of the engine operational zones.

Therefore, the converting means converts the target throttle opening degree to the target opening area, based on the relationship between the throttle opening degree and the opening area of the throttle valve installation portion in the reference deposit state. The correcting means then computes the corrected target opening area by adding the opening area change amount detected by the change amount detecting means to the target opening area obtained by the converting means. The setting means thus determines the updated target throttle opening degree by converting the corrected target opening area to the updated target throttle opening degree based on the relationship between the throttle opening degree and the opening area of the throttle valve installation portion in the reference deposit state.

In this manner, it is possible to set a target throttle opening degree that is suitable for the throttle valve installation portion in a state after the deposit amount has changed. That is, the initial target throttle opening degree is compensated in correspondence with change of the deposit amount.

Accordingly, the target throttle opening degree for the current engine operational zone can be accurately set, regardless of the operational zone in which the engine is operated, after the deposit amount has changed. Thus, by using the target throttle opening degree, the throttle opening degree is controlled with improved accuracy in any one of the engine operational zones, after the amount of the deposits formed in the throttle valve installation portion has changed.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

[First Embodiment]

Figure 1:
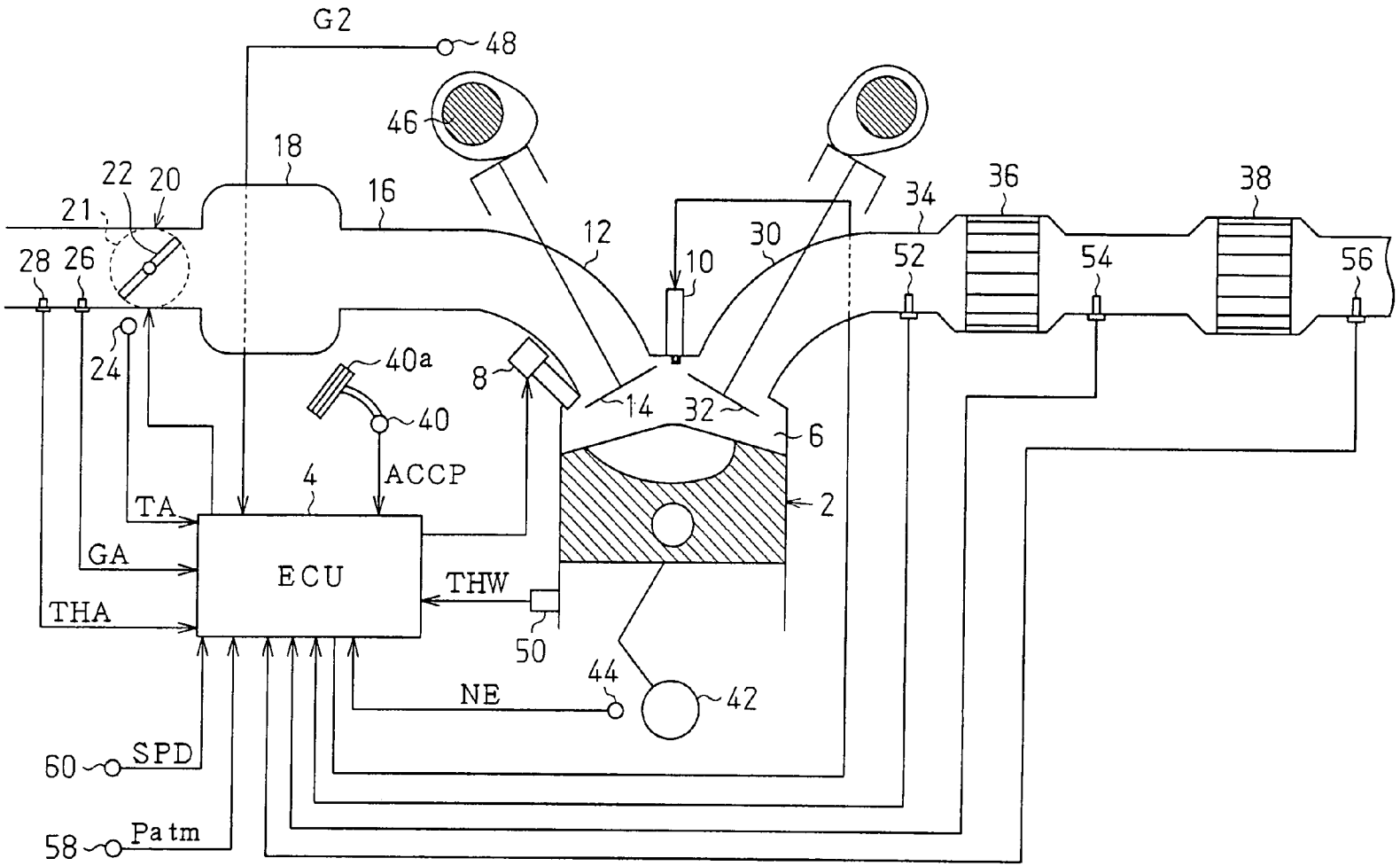
FIG. 1 is a schematic view showing the structure of an engine and an ECU according to a first embodiment of the present invention.

FIG. 1 schematically shows the structure of an in-cylinder injection type gasoline engine (hereinafter, referred to as an "engine") 2, which is provided in a vehicle, and an electronic control unit (ECU) 4. Although FIG. 1 focuses on a structure having only one cylinder, the engine 2 may be a single cylinder type or a multiple cylinder type including, for example, four or six cylinders.

The power of the engine 2 is eventually transmitted to wheels of the vehicle through a transmission as the drive force. The engine 2 has a fuel injection valve 8 directly injecting fuel into a combustion chamber 6 and a spark plug 10 igniting the air-fuel mixture generated by the fuel. An intake port 12 is connected to the combustion chamber 6 and selectively opened or closed through actuation of an intake valve 14. A surge tank 18 is arranged in an intake passage 16 connected to the intake port 12. A throttle body 20 is provided upstream from the surge tank 18. A throttle valve 22 is deployed in the throttle body 20. The open degree of the throttle valve 22 is adjusted by an electric motor 21. The intake air amount GA of the engine 2 is adjusted in correspondence with the opening size of the throttle valve 22, or the throttle opening degree TA (corresponding to the actual throttle opening degree). The throttle opening degree TA is detected by a throttle opening degree sensor 24, which is disposed in the throttle body 20. The intake air amount GA of the engine 2 is detected by an intake air amount sensor 26 provided upstream from the throttle valve 22 in the intake passage 16. The detection results of the throttle opening degree TA and the intake air amount GA are read by the ECU 4. Further, an intake air temperature sensor 28, which is arranged upstream from the throttle valve 22, detects the intake air temperature THA. The detection result is read by the ECU 4.

An exhaust port 30 connected to the combustion chamber 6 is selectively opened or closed through actuation of an exhaust valve 32. A three-way start catalyst 36 and a NOx occlusion-reduction catalyst 38 are arranged in an exhaust passage 34 connected to the exhaust port 30. The start catalyst 36 has an $O_2$ storage function for removing the substances such as HC or CO elements discharged by a large amount when the engine 2 is started.

The ECU 4 is en engine control circuit configured mainly by a digital computer. The ECU 4 receives a signal from an accelerator pedal position sensor 40 detecting the depression amount of an accelerator pedal 40*a* (the accelerator pedal position ACCP), in addition to the signals from the throttle opening degree sensor 24, the intake air amount sensor 26, and the intake air temperature sensor 28. Further, the ECU 4 receives signals from an engine speed sensor 44 detecting the engine speed NE depending on the rotation of a crankshaft 42, a reference crank angle sensor 48 determining a reference crank angle G2 based on the rotation of an intake camshaft 46, and a coolant temperature sensor 50 detecting the engine coolant temperature THW. The input signals received by the ECU 4 also include those from an air-fuel ratio sensor 52 located upstream from the start catalyst 36 for detecting the air-fuel ratio in accordance with the components of the exhaust and two 02 sensors 54, 56 detecting the $O_2$ contents in the exhaust at their respective locations. Other than those above-described, the ECU 4 receives signals from different sensors necessary for controlling the engine 2, including an atmospheric pressure sensor 58 detecting the atmospheric pressure Patm and a vehicle speed sensor 60 detecting the vehicle speed SPD.

In accordance with the detection results of the above-described sensors, the ECU 4 controls the fuel injection valve 8, the spark plug 10, the electric motor 21 such that the fuel injection timings and the fuel injection amount of the engine 2, as well as the spark timing and the throttle opening degree TA, are adjusted as needed. In this manner, the combustion mode of the engine 2 may be switched between the stratified combustion and the homogeneous combustion or the stoichiometric combustion (the homogeneous combustion) and the lean combustion.

If the combustion mode is set to stratified combustion, the throttle valve 22 is controlled to be held open, such that the fuel is injected in the compression stroke by an amount corresponding to the accelerator pedal position ACCP but relatively small as compared to the intake air amount with respect to the stoichiometric air-fuel ratio.

If the combustion mode is set to homogeneous combustion (the stoichiometric combustion), the opening degree of the throttle valve 22 is adjusted in correspondence with the accelerator pedal position ACCP, such that the fuel is injected in the intake stroke by an amount corresponding to the stoichiometric fuel-air ratio (or, in some cases, by an amount richer than respect to the stoichiometric air-fuel ratio).

If the combustion mode is set to lean combustion, the throttle valve 22 is held open with the throttle opening degree TA controlled in correspondence with the accelerator pedal position ACCP, such that the fuel is injected in the intake stroke by an amount relatively small as compared to the intake air amount with respect to the stoichiometric air-fuel ratio.

However, such switching of the combustion mode does not necessarily have to be conducted. That is, the engine 2 may perform homogeneous combustion (stoichiometric combustion) by injecting fuel constantly during the intake stroke, or injecting fuel during the intake stroke and the compression stroke.

A throttle opening degree control procedure executed by the ECU 4 in the first embodiment will now be explained with reference to the flowchart of FIG. 2.

The throttle opening degree control procedure is performed by the ECU 4 periodically and repeatedly. First, in the procedure, a target throttle opening degree TAt is read (in step S102). As aforementioned, the target throttle opening degree TAt is varied depending on in which combustion mode the engine 2 is operated. More specifically, in accordance with each of the combustion modes, a required throttle opening degree is set in correspondence with the operational state of the engine 2 and that of the vehicle.

Next, an opening area change amount dDS is read (in step S104). The opening area change amount dDS is varied in correspondence with the amount of deposits generated on a throttle valve installation portion. The throttle valve installation portion corresponds to the electric motor 21, the throttle valve 22, the throttle opening degree sensor 24, and the throttle body 20.

Figure 3:
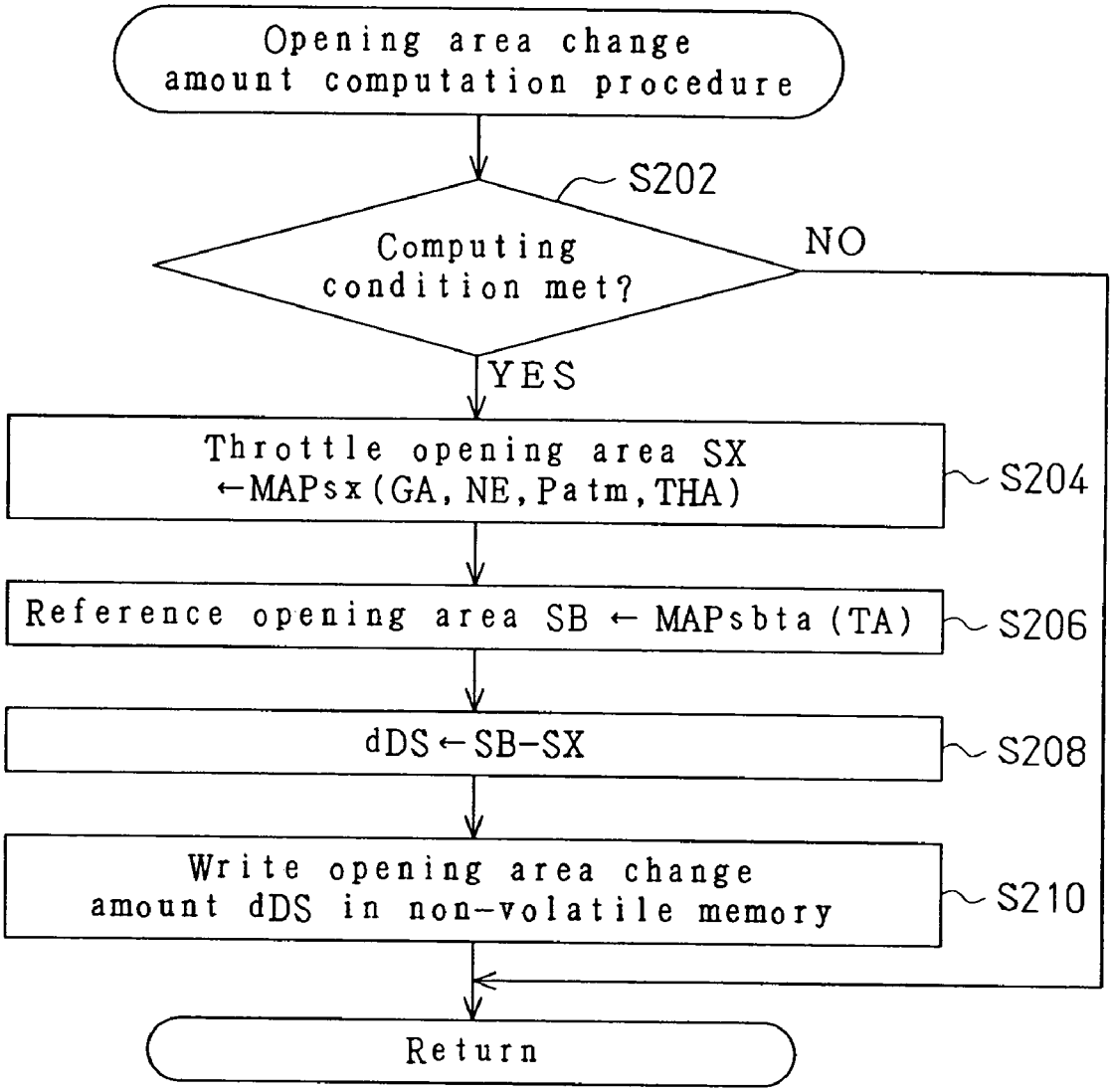
FIG. 3 is a flowchart indicating the opening area change amount computation procedure.

The opening area change amount dDS is determined using an opening area change amount computation procedure as shown in FIG. 3.

The opening area change amount computation procedure is executed as follows. The procedure is performed periodically. First, it is determined whether or not a computation condition is satisfied (in step S202). Depending on the computation condition, it is determined whether or not the engine 2 is operated in a stable state such that the opening area change amount dDS can be detected accurately. More specifically, if the engine 2 is idling while the intake air amount GA, the engine speed NE, the atmospheric pressure Patm, and the intake air temperature THA remain stable and such stable state lasts for a predetermined time, it is determined that the engine 2 is operated in a stable state and the opening area change amount dDS can be detected accurately.

If the computation condition is not satisfied (NO in step S202), the computation procedure is suspended. In this case, no substantial controlling is performed. That is, the opening area change amount dDS is not updated.

In contrast, if the computation condition is met (YES in step S202), a throttle opening area SX is obtained using a first map MAPsx, as indicated by the following equation (1) (step S204):

$$SX \leftarrow MAPsx\ (GA, NE, Patm, THA) \qquad \text{[Equation 1]}$$

The first map MAPsx is obtained experimentally by changing the amount of the deposits generated on the throttle valve installation portion of a standard engine, using the intake air amount GA, the engine speed NE, the atmospheric pressure Patm, and the intake air temperature THA as parameters. Alternatively, the map may be obtained through theoretical calculation, instead of experiments.

Next, in accordance with the throttle opening degree TA detected by the throttle opening degree sensor 24 and with reference to a second map MAPsbta, the opening area is computed and set as a reference opening area SB (in step S206). The second map MAPsbta represents the relationship between the throttle opening degree TA and the opening area that are measured in the engine in which the amount of the deposits generated on the throttle valve installation portion corresponds to a reference deposit state.

Figure 4:
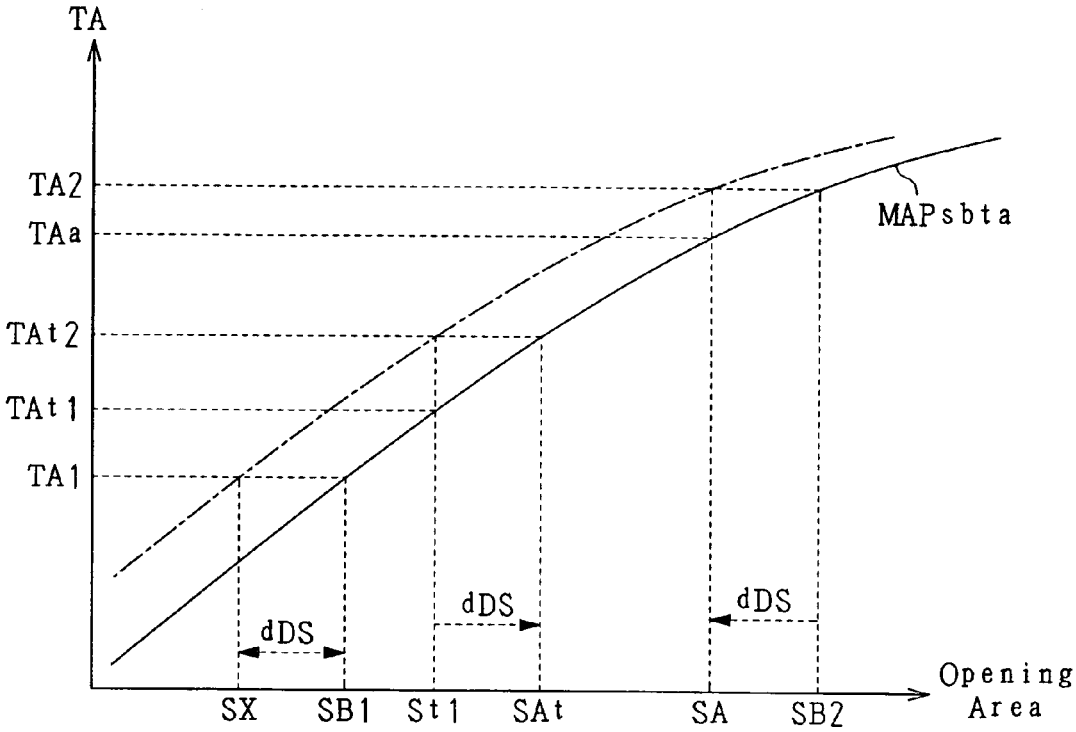
FIG. 4 is a graph indicating a reference relationship map MAPsbta and a state in which the deposit amount is changed.

The second map MAPsbta is shown by the solid line in FIG. 4. For obtaining the second map MAPsbta, an unused throttle body 20 in which the deposits are not formed is used as the reference deposit state. The relationship between the throttle opening degree TA and the opening area of the throttle body 20 is then determined through experiments or theoretical calculation and mapped as the second map MAPsbta.

For example, if the current throttle opening degree TA corresponds to TA1, the reference opening area SB corresponds to SB1, as shown in FIG. 4, with reference to the second map MAPsbta.

Next, as indicated by the following equation (2), the opening area change amount dDS is determined by subtracting the throttle opening area SX from the reference opening area SB (in step S208):

$$dDS \leftarrow SB - SX \quad \text{[Equation 2]}$$

The opening area change amount dDS indicates the change amount of the opening area of the throttle body 20 due to the change of the deposit amount. In the first embodiment, the opening area change amount dDS indicates the change of the opening area of the throttle body 20 with respect to the state in which the amount of the deposits are zero (or the unused state), when the deposits are generated. It has been made clear by the inventor of the present invention that, if a change of the deposit amount is brought about, the opening area change amount dDS is maintained as constant regardless of in which operational zone the engine 2 is operated.

Figure 5:
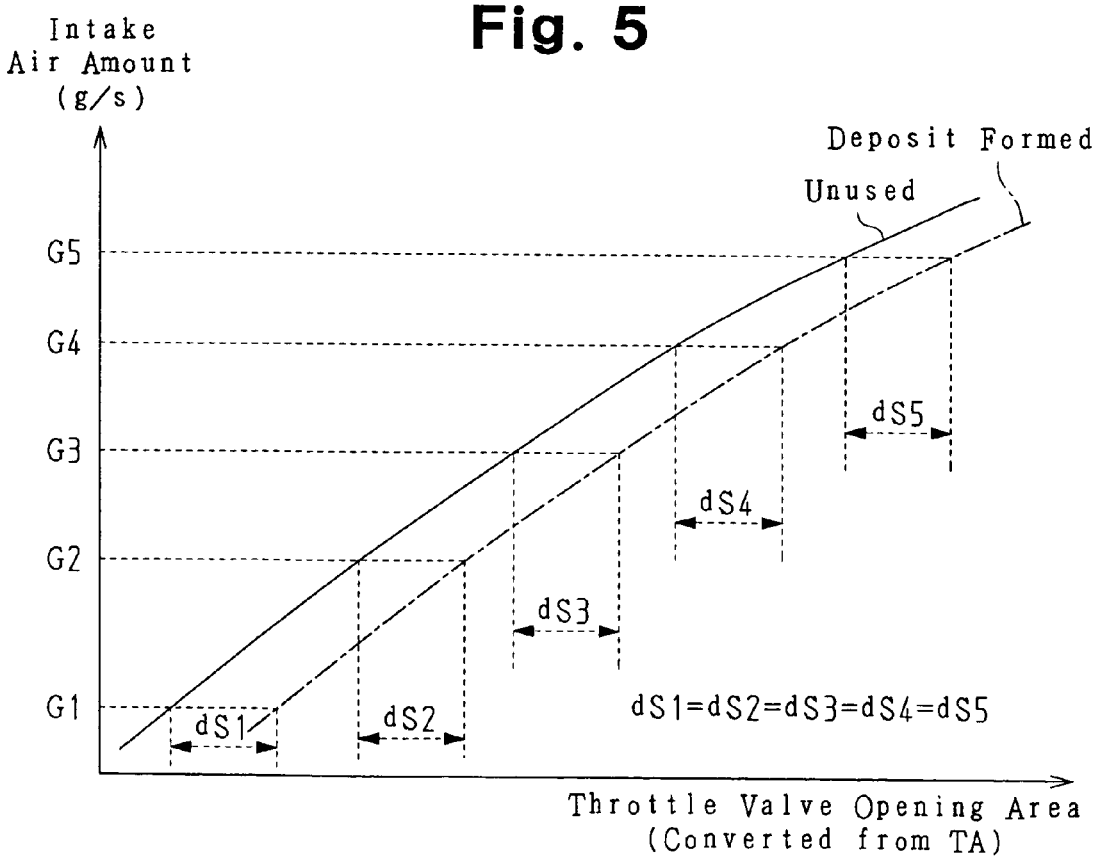
FIG. 5 is a graph indicating the opening area versus the intake air amount, in correspondence with a reference deposit state and a state in which the deposit amount is changed.

In other words, if the throttle valve 22 is actuated by the electric motor 21 such that the throttle opening degree TA is changed, the intake air amount is altered in correspondence with the change of the throttle opening degree TA. If the throttle opening degree TA is converted to the opening area and indicated as the opening area versus the intake air amount as shown in FIG. 5, the difference between the opening area of the unused object (indicated by the solid line) and that of the deposit-formed object (indicated by the dotted broken line) is maintained as constant (dS1=dS2=dS3=dS4=dS5), regardless of variation of the intake air amount.

Thus, also in FIG. 4, the relationship between the throttle opening degree TA and the actual opening area of the deposit-formed object (indicated by the dotted broken line) is obtained by reducing the reference value (indicated by the solid line) in accordance with the constant opening area change amount dDS at any point of the throttle opening degree TA, not only at the point TA1. Therefore, instead of using the throttle opening degree TA directly, the throttle opening degree TA may be converted to the opening area and the converted value is reduced in accordance with the opening area change amount dDS. The resulting value is recovered as the throttle opening degree TA that reflects the current deposit state.

Subsequently, the opening area change amount dDS is written in a non-volatile memory provided in the ECU 4 (in step S210). The procedure is then suspended. In this manner, the opening area change amount dDS is learned. Afterwards, every time the computation condition is satisfied (in step S202), such learning of the opening area change amount dDS is performed and the value dDS is updated, as has been described.

In accordance with the throttle opening degree control procedure (FIG. 2), the opening area change amount dDS learned in the opening area change amount computation procedure (FIG. 3) is read in step S104. Subsequently, depending on the current throttle opening degree TA, the opening area is determined with reference to the second map MAPsbta of FIG. 4 and set as the reference opening area SB (in step S106). This step is the same as step S206 of the opening area change amount computation procedure.

If the throttle opening degree TA corresponds to TA2 at this stage, the reference opening area SB is determined to be the value SB2.

Next, as indicated by the following equation (3), the opening area change amount dDS is subtracted from the reference opening area SB, such that the actual opening area SA is obtained (in step S108).

$$SA \leftarrow SB - dDS \quad \text{[Equation 3]}$$

That is, the actual opening area SA represents the actual opening area indicated by the dotted broken line in FIG. 4.

Subsequently, with reference to the second map MAPsbta indicated by the solid line in FIG. 4, a control throttle opening degree TAa is computed based on the actual opening area SA (in step S110). The control throttle opening degree TAa corresponds to a value obtained by correcting the actual throttle opening degree TA to a value corresponding to the actual opening area SA in a deposit-free state.

Accordingly, as compared to the throttle opening degree TA detected by the throttle opening degree sensor 24, the control throttle opening TAa represents the amount of the intake air passed through the throttle valve 22 relatively accurately.

Next, using the target throttle opening degree TAt and the control throttle opening degree TAa, a motor output for the electric motor 21 is determined in accordance with a control computation procedure such as PID (in step S112).

More specifically, the target throttle opening degree TAt is obtained without considering formation of the deposits. However, the motor output is obtained using the control throttle opening degree TAa, in addition to the target throttle opening degree TAt. The resulting motor output thus becomes a highly accurate value in which deposit formation is considered.

The output of the electric motor 21 is then controlled in correspondence with the obtained motor output (in step S114). Afterwards, the above-described procedure is repeated periodically.

In the above-described configuration, the throttle opening degree sensor 24 corresponds to throttle opening degree detecting means. The opening area change amount computation procedure (FIG. 3) corresponds to a procedure executed by opening area change amount computing means. The step S106 of the throttle opening degree control procedure (FIG. 2) and the step 206 of the opening area change amount computation procedure (FIG. 3) each correspond to a procedure executed by opening area converting means (a first converter). The step S108 of the throttle opening degree control procedure (FIG. 2) corresponds to a procedure executed by actual opening area computing means. The step S110 of the throttle opening degree control procedure (FIG. 2) corresponds to a procedure executed by throttle opening degree converting means (a second converter).

The first embodiment has the following advantages.

(1) Although the intake air amount is changed in correspondence with variation of the throttle opening degree TA, the opening area change amount dDS, or the difference in the opening area corresponding to the throttle opening degree TA between the unused throttle body 20 and the deposit-formed throttle body 20, is maintained as constant. In other words, the opening area change amount dDS is uninfluenced by changes of the engine operational zones.

Thus, based on the relationship between the throttle opening degree TA and the opening area when the amount of the deposits corresponds to the reference deposit state, as indicated by the solid line in FIG. 4, the throttle opening degree TA is converted to a corresponding reference opening area SB. Then, the opening area change amount dDS corresponding to the deposit amount, which is determined in accordance with the opening area change amount computation procedure (FIG. 3), is subtracted from the obtained reference opening area SB. This makes it possible to obtain the actual opening area SA of the throttle body 20 after the deposit amount is changed.

The opening area change amount dDS corresponding to the change of the deposit amount is a value that has been detected in any one of the engine operational zones (in the first embodiment, such detection is performed when the computation condition is met). However, since the opening area change amount dDS is uninfluenced by changes of the engine operational zones, the actual opening area SA can be accurately determined for the current throttle operational state, regardless of whether or not the engine operational zone in which the opening area change amount dDS has been detected corresponds to the engine operational zone in which the current throttle opening degree TA is detected.

The resulting actual opening area SA is converted to the control throttle opening degree TAa with reference to the map MAPsbta of FIG. 4. In this manner, the actual opening area SA is converted to a throttle opening degree of the throttle body 20 corresponding to the reference deposit state (in the first embodiment, the unused state).

This makes it possible to detect the control throttle opening degree TAa that reflects the actual opening area of the current engine operational zone (the actual opening area SA) with improved accuracy, regardless of in which operational zone the engine 2 is operated, in the throttle body 20 in which the deposit amount is changed. Accordingly, using the control throttle opening degree TAa, the throttle opening degree can be controlled highly accurately, regardless of in which operational zone the engine 2 is operated, even if the amount of the deposits of the throttle body 20 is changed.

(2) The opening area change amount dDS is determined when the engine operational state is stable. The detection of the opening area change amount dDS is thus highly accurate such that the detection accuracy of the control throttle opening degree TAa is further improved. Accordingly, the throttle opening degree can be controlled with improved accuracy in correspondence with changes of the engine operational zones.

[Second Embodiment]

Figure 2:
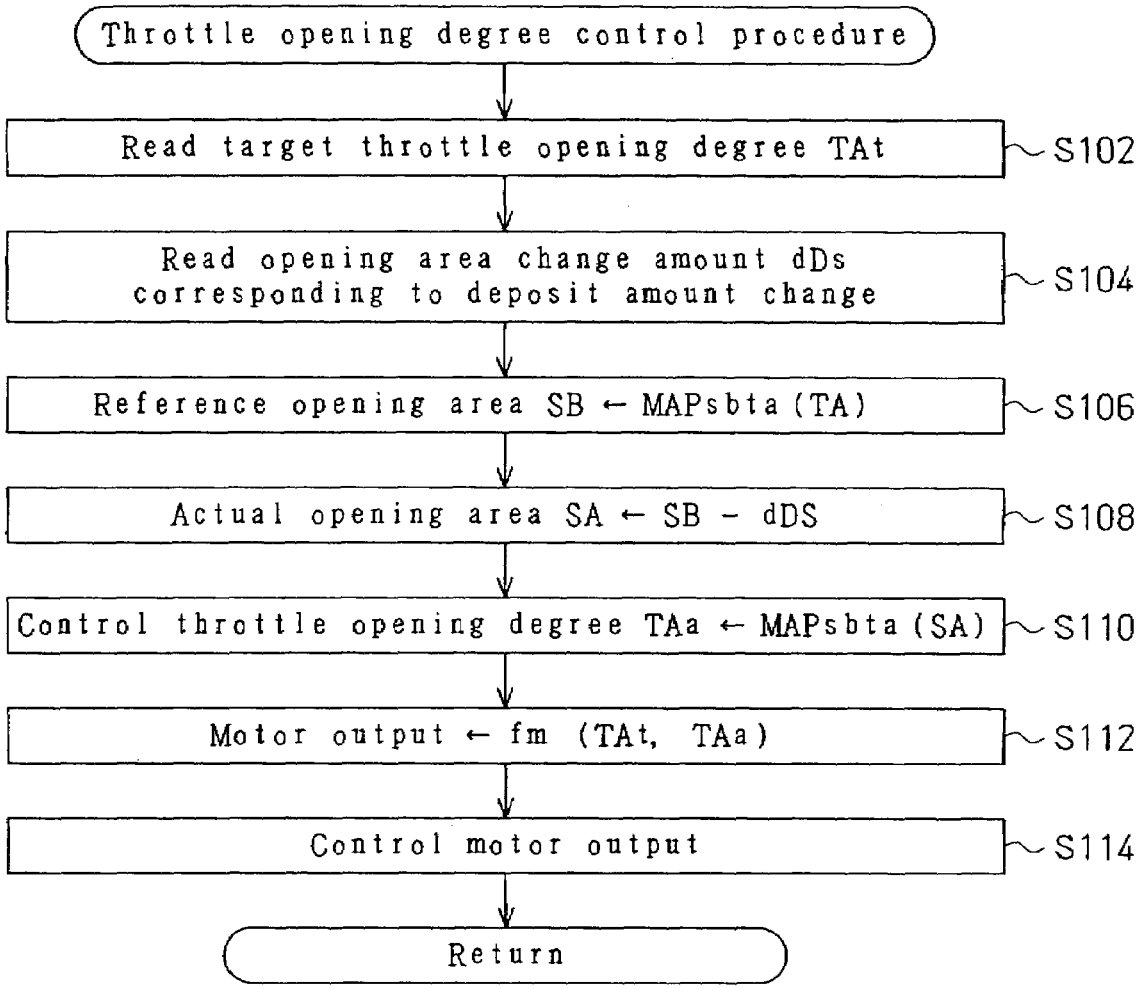
FIG. 2 is a flowchart indicating a throttle opening degree control procedure executed by the ECU.
Figure 6:
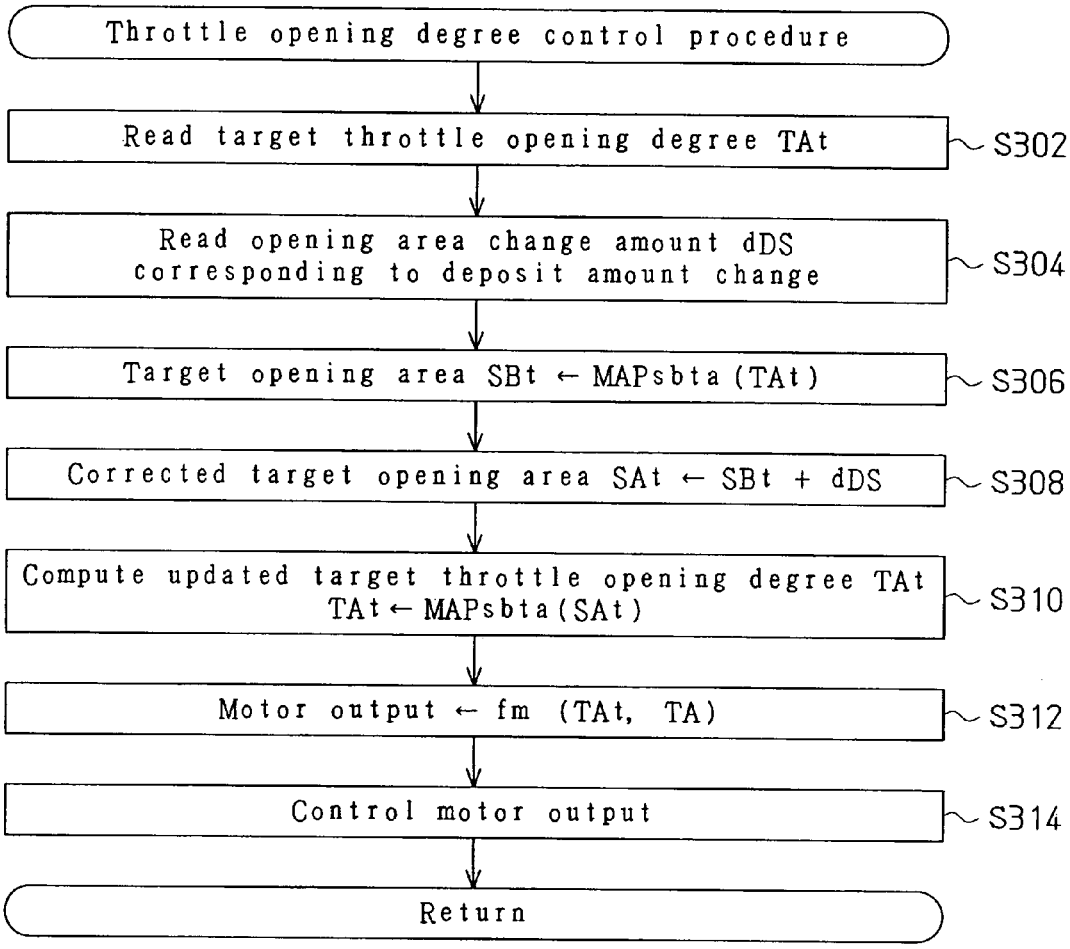
FIG. 6 is a flowchart indicating a throttle opening degree control procedure executed by an ECU according to a second embodiment of the present invention.

In the second embodiment, the ECU 4 executes a throttle opening degree control procedure of FIG. 6, instead of the procedure of FIG. 2, repeatedly and periodically. In the second embodiment, the opening area change amount computation procedure (FIG. 3) and the configuration of FIG. 1 are the same as those of the first embodiment. The second embodiment will thus be explained with reference to FIGS. 1, 3, 4, and 6.

First in the throttle opening degree control procedure (FIG. 6), the target throttle opening degree TAt is read (in step S302). The target throttle opening degree TAt is determined as has been described about the step S102 of the procedure of the first embodiment (FIG. 2). The determination of the target throttle opening degree TAt is thus based on the assumption that the throttle opening degree and the opening area of the throttle body 20 are related to each other as indicated by the solid line of FIG. 4.

Subsequently, the opening area change amount dDS, which corresponds to a change of the amount of the deposits generated in the throttle body 20, is read (in step S304). As has been explained for the first embodiment, the opening area change amount dDS is determined in accordance with the opening area change amount computation procedure (FIG. 3).

Then, in correspondence with the target throttle opening degree TAt, the target opening area SBt is computed with reference to the map MAPsbta, which is indicated by the solid line in FIG. 4 (in step S306).

If the target throttle opening degree TAt corresponds to TAt1 at this stage, the target opening area SBt is determined to be St1.

Next, as indicated by the following equation (4), the opening area change amount dDS is added to the target opening area SBt, such that a corrected target opening area SAt is obtained (in step S308):

$$SAt \leftarrow SBt + dDS \quad \text{[Equation 4]}$$

With reference to the map MAPsbta indicated by the solid line in FIG. 4, an updated target throttle opening degree TAt is then obtained from the corrected target opening area SAt (in step S310). In FIG. 4, the updated target throttle opening degree TAt corresponds to TAt2.

The value TAt2 is a throttle opening degree at which the target opening area SBt corresponds to St1 in accordance with the relationship between the actual throttle opening degree and the opening area, as indicated by the dotted broken line in FIG. 4.

Accordingly, as compared to the target throttle opening degree TAt that is determined based on the relationship between the throttle opening degree TA and the opening area indicated by the solid line of FIG. 4, which has been read in step S302, the updated target throttle opening degree TAt obtained in step S310 reflects the required throttle opening degree with enhanced accuracy.

Subsequently, using the updated target throttle opening degree TAt and the throttle opening degree TA, the motor output for the electric motor 21 is computed in accordance with a control computation procedure fm such as PID (in step S312).

The target throttle opening degree TAt is determined by taking the deposit formation into consideration. The motor output is computed using the actual throttle opening degree TA detected by the throttle opening degree sensor 24, in addition to the target throttle opening degree TAt. The resulting motor output thus becomes a highly accurate value in which the deposit formation is considered.

Next, the output of the electric motor 21 is controlled in correspondence with the obtained motor output (in step S314). Afterwards, the above-described procedure is repeated periodically.

In the above-described configuration, the opening area change amount computation procedure (FIG. 3) corresponds to a procedure executed by opening area change amount computing means. The step S306 of the throttle opening degree control procedure (FIG. 6) corresponds to a procedure executed by opening area converting means. The step S308 of the throttle opening degree control procedure (FIG. 6) corresponds to a procedure executed by correcting means. The step S310 of the throttle opening degree control procedure (FIG. 6) corresponds to a procedure executed by target throttle opening degree setting means.

The second embodiment has the following advantages.

(1) As has been explained about the first embodiment, the opening area change amount dDS of the throttle body 20 in the deposit-formed state with respect to the unused state is uninfluenced by changes of the engine operational zones.

Therefore, based on the relationship between the throttle opening degree TA and the opening area indicated by the solid line of FIG. 4, the target throttle opening degree TAt is converted to the target opening area SBt. The opening area change amount dDS is then added to the target opening area SBt. In this manner, the corrected target opening area SAt, which is the target opening area after the amount of the deposit is changed, is obtained.

As has been described about the first embodiment, the opening area change amount dDS is uninfluenced regardless of whether or not the engine operational zone in which the opening area change amount dDS has been detected corresponds to the current engine operational zone in which the target throttle opening degree TAt is to be set. The corrected target opening area SAt is thus determined accurately.

Accordingly, by setting the corrected target opening area SAt to the updated target throttle opening degree TAt based on the map MAPsbta of FIG. 4, the initial target throttle opening degree TAt is compensated in correspondence with the change of the deposit amount.

In this manner, in the throttle body 20 in which the amount of the deposit is changed, regardless of changes of the engine operational zones, the target throttle opening degree TAt suitable for the current engine operational zone can be determined accurately. Thus, by using such target throttle opening degree TAt, the throttle opening degree of the throttle body 20 can be controlled with improved accuracy in correspondence with the change of the engine operational zone, even after the deposit amount is changed.

(2) Since the detection of the opening area change amount dDS is conducted with enhanced accuracy as has been described in advantage (2) of the first embodiment, the compensation accuracy of the target throttle opening degree TAt is further improved. It is thus possible to control the throttle opening degree with further improved accuracy in correspondence with the change of the engine operational zone.

[Other Embodiments]

(a) In step S204 of the opening area change amount computation procedure (FIG. 3), the throttle opening area SX is obtained using the map MAPsx. However, the throttle opening area SX may be determined through computation based on physical principles.

(b) The parameters employed in the MAPsx of step S204 of the opening area change amount computation procedure (FIG. 3) include the intake air amount GA, the engine speed NE, the atmospheric pressure Patm, and the intake air temperature THA. However, the number of such parameters may be reduced.

For example, it may be determined that the computation condition is satisfied in step S202 of the procedure of FIG. 3 if the atmospheric pressure Patm and the intake air temperature THA reach respective reference values. This makes it possible to limit the parameters of the map MAPsx to the intake air amount GA and the engine speed NE. Further, it may be determined that the computation condition is satisfied in step S202 if the engine speed NE also reaches a reference value, in addition to the atmospheric pressure Patm and the intake air temperature THA. In this manner, only the intake air amount GA is employed as the parameter of the map MAPsx.

(c) In each of the illustrated embodiments, it is determined that the reference deposit state is defined as the state in which the deposit is not formed. However, such reference deposit state may correspond to the state in which the deposit is formed in the throttle body 20. In this case, the actual amount of the deposit of the throttle body 20 may become smaller than the reference deposit state. If this is the case, the opening area change amount dDS is represented by a negative value.

(d) Although the engine 2 of FIG. 1 is an in-cylinder injection type gasoline engine, the engine 2 may be a gasoline engine in which fuel is injected into an intake port.

The present examples and embodiments are to be considered as illustrative and not restrictive and the invention is not to be limited to the details given herein, but may be modified within the scope and equivalence of the appended claims.

The invention claimed is:

1. A detection method for throttle opening degree in an internal combustion engine having a throttle valve installation portion that deposits accumulate thereon, the method comprising the steps of:

converting an actual throttle opening degree determined through actual detection to an opening area, based on a relationship between throttle opening degree and the opening area of the throttle valve installation portion when the throttle valve installation portion is in a reference deposit state;

determining an actual opening area by subtracting an opening area change amount of the throttle valve installation portion, which corresponds to a change in deposit amount with respect to the reference deposit state, from the opening area; and determining a control throttle opening degree by converting the actual opening area to the control throttle opening degree based on the relationship between the throttle opening degree and the opening area of the throttle valve installation portion in the reference deposit state.

2. A compensation method for a target throttle opening degree used for adjusting throttle opening degree in an internal combustion engine having a throttle valve installation portion that deposits accumulate thereon, the method comprising the steps of:

converting the target throttle opening degree to a target opening area, based on the relationship between throttle opening degree and opening area of the throttle valve installation portion when the throttle valve installation portion is in a reference deposit state;

determining a corrected target opening area by adding an opening area change amount of the throttle valve installation portion, which corresponds to a change in deposit amount with respect to the reference deposit state, to the target opening area; and determining an updated target throttle opening degree by converting the corrected target opening area to the updated target throttle opening degree based on the relationship between the throttle opening degree and the opening area of the throttle valve installation portion in the reference deposit state.

3. A detection device for throttle opening degree in an internal combustion engine having a throttle valve installation portion that deposits accumulate thereon, the device comprising:

throttle opening degree detecting means for detecting actual throttle opening degree;

change amount detecting means for detecting opening area change amount corresponding to change in deposit amount on the throttle valve installation portion;

converting means for converting the throttle opening degree as actually detected by the throttle opening degree detecting means to an opening area based on a relationship between the throttle opening degree and the opening area of the throttle valve installation portion in a reference deposit state;

computing means for determining an actual opening area by subtracting the opening area change amount detected by the change amount detecting means from the opening area determined by the converting means; and throttle opening degree converting means for determining a control throttle opening degree by converting the actual opening area determined by the computing means to the control throttle opening degree based on the relationship between the throttle opening degree and the opening area of the throttle valve installation portion in the reference deposit state.

4. The device according to claim 3, wherein the change amount detecting means determines the opening area change amount from the difference between the opening area obtained by the converting means and the opening area computed in correspondence with an actual measurement of an intake air amount when the engine is operated in a stable state.

5. The device according to claim 3, wherein the reference deposit state corresponds to a deposit-free state.

6. The device according to claim 4, wherein the reference deposit state corresponds to a deposit-free state.

7. A compensation device for target throttle opening degree for adjusting throttle opening degree in an internal combustion engine having a throttle valve installation portion that deposits accumulate thereon, the device comprising:

change amount detecting means for detecting opening area change amount corresponding to change in deposit amount on the throttle valve installation portion;

converting means for converting the target throttle opening degree to a target opening area, based on a relationship between the throttle opening degree and an opening area of the throttle valve installation portion in a reference deposit state;

correcting means for computing a corrected target opening area by adding the opening area change amount detected by the change amount detecting means to the target opening area obtained by the converting means; and setting means for determining an updated target throttle opening degree from the corrected target opening area computed by the correcting means based on the relationship between the throttle opening degree and the opening area of the throttle valve installation portion in the reference deposit state.

8. The device according to claim 7, wherein the change amount detecting means determines the opening area change amount from the difference between the opening area obtained by the converting means and the opening area computed in correspondence with an actual measurement of an intake air amount when the engine is operated in a stable state.

9. The device according to claim 7, wherein the reference deposit state corresponds to a deposit-free state.

10. The device according to claim 8, wherein the reference deposit state corresponds to a deposit-free state.

11. The device according to claim 7, wherein the throttle valve installation portion includes:

a throttle body connected to an intake passage of the engine;

a throttle valve capable of adjusting the throttle opening degree in the throttle body;

an electric motor for actuating the throttle valve; and a sensor for detecting the throttle opening degree.

12. A detection device for throttle opening degree in an internal combustion engine having a throttle valve installation portion that deposits accumulate thereon, the device comprising:

a throttle opening degree detector which detects actual throttle opening degree;

a change amount detector which detects opening area change amount corresponding to change in deposit amount on the throttle valve installation portion;

a first converter in communication with the throttle opening degree detector in which the first converter converts the throttle opening degree as actually detected by the throttle opening degree detector to an opening area based on a relationship between the throttle opening degree and the opening area of the throttle valve installation portion in a reference deposit state;

an electronic control unit in communication with the change amount detector and the converter in which the electronic control unit determines an actual opening area by subtracting the opening area change amount detected by the change amount detector from the opening area determined by the converter; and a second converter in communication with the electronic control unit in which the second converter determines a control throttle opening degree by converting the actual opening area determined by the electronic control unit to the control throttle opening degree based on the relationship between the throttle opening degree and the opening area of the throttle valve installation portion in the reference deposit state.

13. The device according to claim 12, wherein the change amount detector determines the opening area change amount from the difference between the opening area obtained by the first converter and the opening area computed in correspondence with an actual measurement of an intake air amount when the engine is operated in a stable state.

14. The device according to claim 12, wherein the reference deposit state corresponds to a deposit-free state.

15. The device according to claim 13, wherein the reference deposit state corresponds to a deposit-free state.

* * * * *